US008400250B2

(12) United States Patent
Nagano et al.

(10) Patent No.: US 8,400,250 B2
(45) Date of Patent: Mar. 19, 2013

(54) COMPOSITE TRANSFORMER

(75) Inventors: Masao Nagano, Saitama (JP); Satoshi Hashino, Saitama (JP); Mitsuaki Hirakawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/224,376

(22) Filed: Sep. 2, 2011

(65) Prior Publication Data

US 2012/0062349 A1 Mar. 15, 2012

(30) Foreign Application Priority Data

Sep. 3, 2010 (JP) ..... 2010-197416

(51) Int. Cl.
*H01F 27/24* (2006.01)
*H01F 17/04* (2006.01)

(52) U.S. Cl. ..... 336/212; 336/221

(58) Field of Classification Search ..... 336/212, 336/219, 220, 221
See application file for complete search history.

(56) References Cited

U.S. PATENT DOCUMENTS 5,066,900 A * 11/1991 Bassett ..... 323/224
5,454,034 A * 9/1995 Martin ..... 379/230
5,455,553 A * 10/1995 Allan et al. ..... 336/170
5,523,673 A * 6/1996 Ratliff et al. ..... 323/206
5,783,984 A * 7/1998 Keuneke ..... 336/155
5,790,005 A * 8/1998 Santi et al. ..... 335/296
6,046,664 A * 4/2000 Weller et al. ..... 336/212
6,060,974 A * 5/2000 Schroter et al. ..... 336/192
6,972,657 B1 * 12/2005 Pacala et al. ..... 336/200
6,980,078 B2 * 12/2005 Rouser ..... 336/216
7,633,369 B2 * 12/2009 Chandrasekaran et al. .. 336/212
7,839,255 B2 11/2010 Nagano et al.
8,013,710 B2 * 9/2011 Lai et al. ..... 336/212
8,031,042 B2 * 10/2011 Silva ..... 336/212
8,134,443 B2 * 3/2012 Chandrasekaran et al. .. 336/212

FOREIGN PATENT DOCUMENTS

JP 2005-224058 A 8/2005
JP 2009-284647 A 12/2009

* cited by examiner

*Primary Examiner* — Mohamad Musleh
*Assistant Examiner* — Joselito Baisa
(74) *Attorney, Agent, or Firm* — Squire Sanders (US) LLP

(57) ABSTRACT

A composite (combined type of) transformer includes: a transformer core including a plurality of transformer magnetic leg portions, a transformer magnetic leg portion, and a pair of transformer bases; a plurality of inductor cores each including an inductor magnetic leg portions, inductor outer magnetic leg portions, and a pair of inductor bases; and a plurality of windings wound around the transformer magnetic leg portion and the inductor magnetic leg portions. The windings are wound to generate magnetic fluxes in such directions as to be cancelled out in a magnetic closed circuit in the transformer core.

7 Claims, 6 Drawing Sheets

COMPARATIVE EXAMPLE 1

COMPARATIVE EXAMPLE 2

COMPARATIVE EXAMPLE 3

COMPOSITE TRANSFORMER

CROSS REFERENCE TO RELATED APPLICATION

This application claims the foreign priority benefit under Title 35, United States Code, §119(a)-(d) of Japanese Patent Application No. 2010-197416, filed on Sep. 3, 2010 in the Japan Patent Office, the disclosure of which is herein incorporated by reference in its entirety.

BACKGROUND OF THE INVENTION

1. Field of the Invention

The present invention relates to a composite transformer (combined type of transformer) and particularly to a composite transformer with a little energy loss used in a power converter for down sizing.

2. Description of the Related Art

Composite transformers (combined type of transformers) are known which are used in a DC (Direct Current)-DC converter. JP 2005-224058 discloses a DC-DC converter having a magnetic flux canceling type of transfer (hereinafter referred to only as a transformer) in which a plurality of windings are disposed in such a direction that the magnetic fluxes generated by respective windings are cancelled out.

JP 2009-284647 discloses another composite transformer modified from the composite transformer disclosed in JP 2005-224058. This composite transformer has windings for a transformer and an inductor for boosting and bucking which are shared between the transformer and the boosting-and-bucking inductor in which the transformer and the inductor are integrally formed.

However, the composite transformer disclosed in FIGS. 3 and 4 of JP 2009-284647 has two windings wound around a center magnetic leg portion of the transformer are alternately overlapped along the center magnetic leg portion.

Therefore, this configuration may invite an excessively high magnetic density over a saturation magnetic flux density at the center magnetic leg portion which causes a loss in magnetic energy.

Though the conventional composite transformers can be formed smaller than a case where coils for an inductor and transformer are separately provided because the coils are shared between the inductor and transformer of the conventional composite transformer.

Therefore, it is desirable to provide a further down-sized composite transformer with a reduced magnetic energy loss.

SUMMARY OF THE INVENTION

A first aspect of the present invention provides a combined type of transformer comprising:

two windings;

a transformer core including a transformer magnetic leg portion around which the windings are wound, the transformer magnetic leg portion extending in the axial direction of the windings;

two inductor cores disposed in the axial direction, each including an inductor magnetic leg portion around which one of the windings is wound and being disposed next to the transformer core, wherein when at least one of the windings is conducted, a magnetic flux is generated at the transformer magnetic leg portion and the inductor magnetic leg portions, which provides functions of a transformer and inductors, wherein the transformer core comprises:

the transformer magnetic leg portion;

an transformer outer magnetic leg portion extending in parallel to the transformer magnetic leg portion, disposed outside an outer circumferential surfaces of the windings; and a pair of transformer bases respectively connecting ends of the transformer magnetic leg portion and ends of the outer magnetic leg portion; wherein each of the inductor cores comprises:

the inductor magnetic leg portion;

an inductor outer magnetic leg portion extending in parallel to the inductor magnetic leg portion, disposed outside an outer circumferential surface; and a pair of inductor bases respectively connecting ends of the inductor magnetic leg portion and ends of the inductor outer magnetic leg portion. The windings are wound to generate magnetic fluxes in such directions that the magnetic fluxes are cancelled out in a magnetic closed circuit in the transformer core.

According to the composite transformer of the present invention, when one of two windings is excited by current flow, a magnetic flux is generated at the magnetic leg portion of the transformer and circulates through the transformer core which a magnetic closed circuit.

The magnetic flux circulating through the transformer core magnetically induces the other winding wound around the magnetic leg portion of the transformer.

The windings are wound so that magnetic fluxes generated by the windings in the closed magnetic circuit of the transformer core are cancelled out each other. Accordingly, in the magnetic fluxes circulating through the transformer core may provide magnetic induction such that the magnetic flux generated by one of the windings functions to boost an output voltage of the other of the windings. When a current flows through one of the windings, the output of the other of the windings may be boosted through the transformer core.

In addition, when one of the windings is excited by current flow, the inductor magnetic leg portion may also generate magnetic flux which circulates through an inductor core, which is a magnetic closed circuit. Accordingly, when currents flow through respective windings, the magnetic flux circulates through the inductor core, which may store a magnetic energy.

Because the transformer magnetic leg portion of the composite transformer extends in an axial direction of the windings, the magnetic flux density there does not become excessive, though two windings are wound around the transformer magnetic leg portion. The composite transformer according to the present invention can avoid energy loss caused by generation of magnetic flux having a magnetic flux density exceeding a saturation magnetic field density of the transformer magnetic leg portion.

In addition, because two windings are wound so that the magnetic fluxes generated by the windings are cancelled out each other in the transformer core, which is a closed magnetic circuit, residual magnetization is reduced in the transformer core. Therefore, the composite transformer according to the present invention can reduce a loss in magnetic energy due to the residual magnetization.

A second aspect of the present invention provides the combined type of transformer based on the first aspect, wherein the windings include connection terminals to be connected to both polarity terminals of an external electric circuit, and the connection terminals extend in the same direction.

According to this configuration, the connection terminals of the two windings are drawn on one side of the composite transformer. This makes it easy to perform a connection operation between the connection terminals of the two windings with an external electric circuit, so that efficiency in connecting the connection terminals with the external electric circuit can be improved.

A third aspect of the present invention provides the composite transformer based on the first aspect, further comprising a magnetic insulation sheet between the transformer core and the inductor core.

This configuration may prevent the magnetic fields generated in the transformer core and the inductor core from influencing on each other.

The present invention may provide a composite transformer down-sized with reduction in the magnetic energy loss.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

With reference to drawings will be described an embodiment of composite transformer (combined type of transformer).

The same or corresponding elements or parts in the description of the embodiment are designated with like references.

<Composite Transformer 1>

Figure 1A:
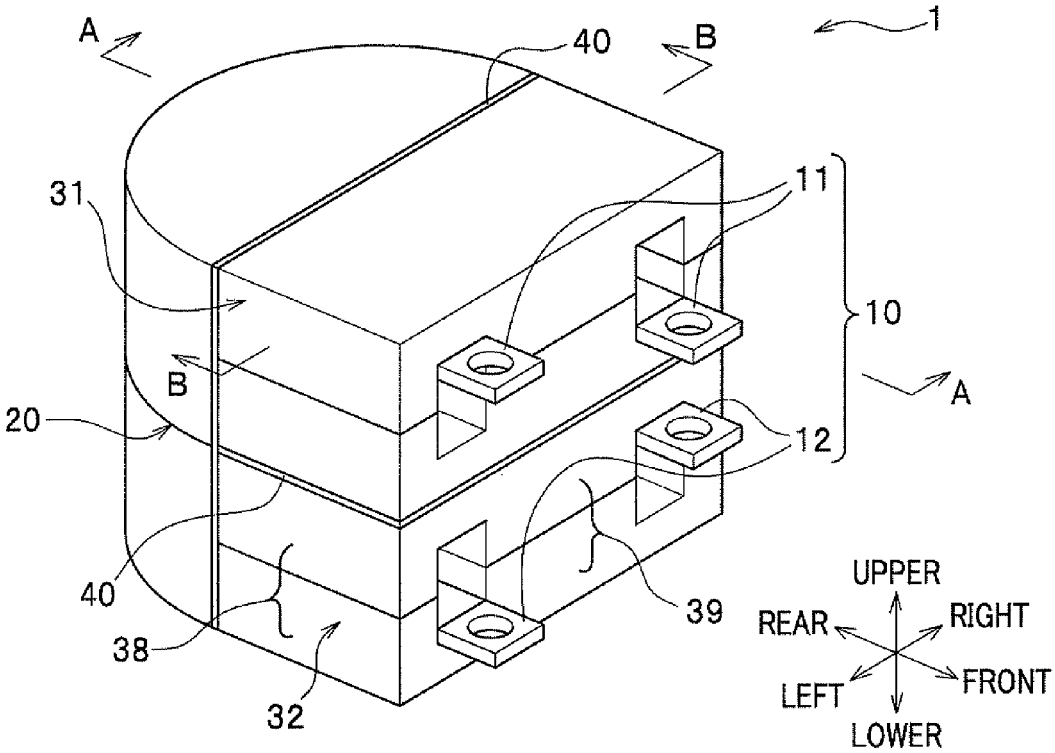
FIG. 1A is a perspective view of a composite transformer according to an embodiment of the present invention when viewed from a left upper side on a front side.
Figure 1B:
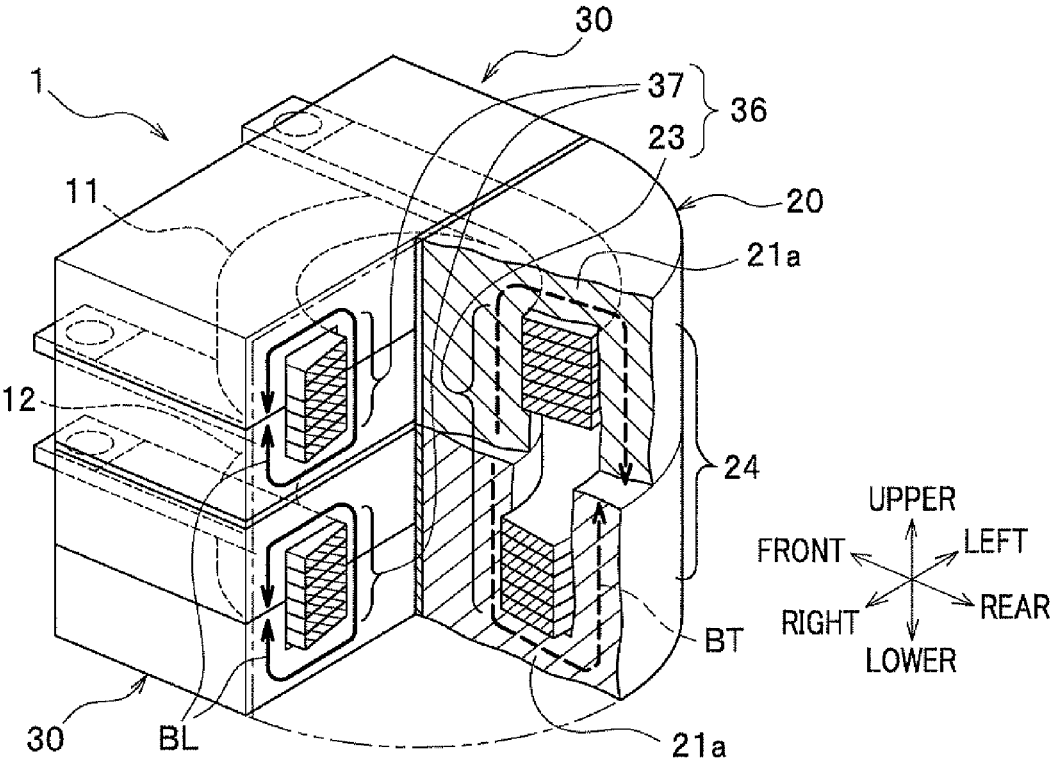
FIG. 1B is a perspective view of the composite transformer according to the embodiment of the present invention when viewed from a right upper side on the rear side.

A composite transformer 1 according to the embodiment is a two-phase composite type of transformer which includes two windings 10 and formed with a transformer portion and an inductor portion integrally as shown in FIGS. 1A and 1B. In the composite transformer in the present embodiment, two windings 10 are used. In a case where these windings 10 are distinctively described therebetween, the winding 10 disposed on an upper side is referred to as a first winging 11 and the winding 10 disposed on a lower side will be referred to as a second winding 12.

The composite transformer includes, as shown in FIG. 1, in addition to the windings 10, a transformer core 20 for supporting the windings 10, two inductor cores 30, 30 vertically disposed, magnetic insulation sheets 40 disposed between the transformer core 20 and the inductor cores 30 and between inductor cores 30, 30.

<Windings 10>

The windings 10 are connected to an external electric circuit and convert an electric current supplied from the external electric circuit into magnetic energy.

The composite transformer 1 includes two windings 10, each being a coil having a sleeve shape provided by winding a wire such as a copper line spirally, coaxially. Both ends of the coils have connection terminals 11*a*, 11*b*, 12*a*, and 12*b*.

However, the sleeve shape coil of the first winding 11 is formed by that a wire is wound clockwise (viewed from an upper side) from the connection terminal 11*a* toward the terminal 11*b*. The second winding 12 is formed by that a wire is wound counterclockwise (viewed from an upper side) from the connection terminal 12*a* toward the terminal 12*b*.

The connection terminals 11*a* and 11*b* of the first winding 11 extend in the same direction from the winding body.

The connection terminals 12*a* and 12*b* of the second winding 12 extend in the same direction from the winding body.

The first and second winging 11 and 12 have the same number of turns. However, the number of turns is not limited in this invention.

The first and second windings 11 and 12 are disposed vertically and a magnetic leg portion 36 (mentioned later) is inserted into inside of the coils of the first and second windings 11 and 12 to support the first and second windings 11 and 12 within the transformer core 20 in the axial direction.

As mentioned above, the shapes, etc. of the windings 11 and 12 have been described. The winding directions of the first and second windings 11 and 12 will be further described after description of the transformer core 20 and the inductor core 30.

Hereinafter, the axial direction in forming the windings 11 and 12 will be referred to simply as "axial direction of the winding" or "vertical direction". In addition, the direction of the connection terminals 11*a* and 11*b* extending from the winding body which is orthogonal to the axial direction of the windings 11 and 12 is referred to as "front-rear direction" and a direction orthogonal to the vertical direction (upper-lower direction) and the front and rear direction is refereed to as "left-right direction".

<Transformer Core 20>

The transformer core 20 is a magnetic member for magnetically coupling the two windings 10 and comprises the transformer magnetic leg portion 23 on which the windings 10 are wound, the transformer outer magnetic leg portion 23 extending in parallel to the transformer magnetic leg portion 23, a pair of the transformer bases 21*a* and 21*a* for connecting ends of the transformer magnetic leg portion 23 and the transformer outer magnetic leg portion 24.

The transformer magnetic leg portions 23 are portions on which the windings 10 are wound as shown in FIG. 1B and extending in the axial direction of the windings 10.

The transformer magnetic leg portion 23 is formed to have a substantially semi-circle when viewed from vertical directions.

In the present embodiment, the number of the windings 10 wound around the transformer magnetic leg portions 23 is two, i.e., first and second windings 11 and 12 which are vertically disposed as shown in FIG. 1B. Accordingly, the transformer magnetic leg portion 23 extends in the axial direction of the two windings 10 to have a total length of the windings 10 in the axial direction so as to allow the windings 10 disposed in the axial direction to be wound therearound continuously.

The transformer outer magnetic leg portion 24 is formed, as shown in FIG. 1B, in parallel to the transformer magnetic leg portion 23 outside the outer circumferential surfaces of the windings 10.

Figure 3:
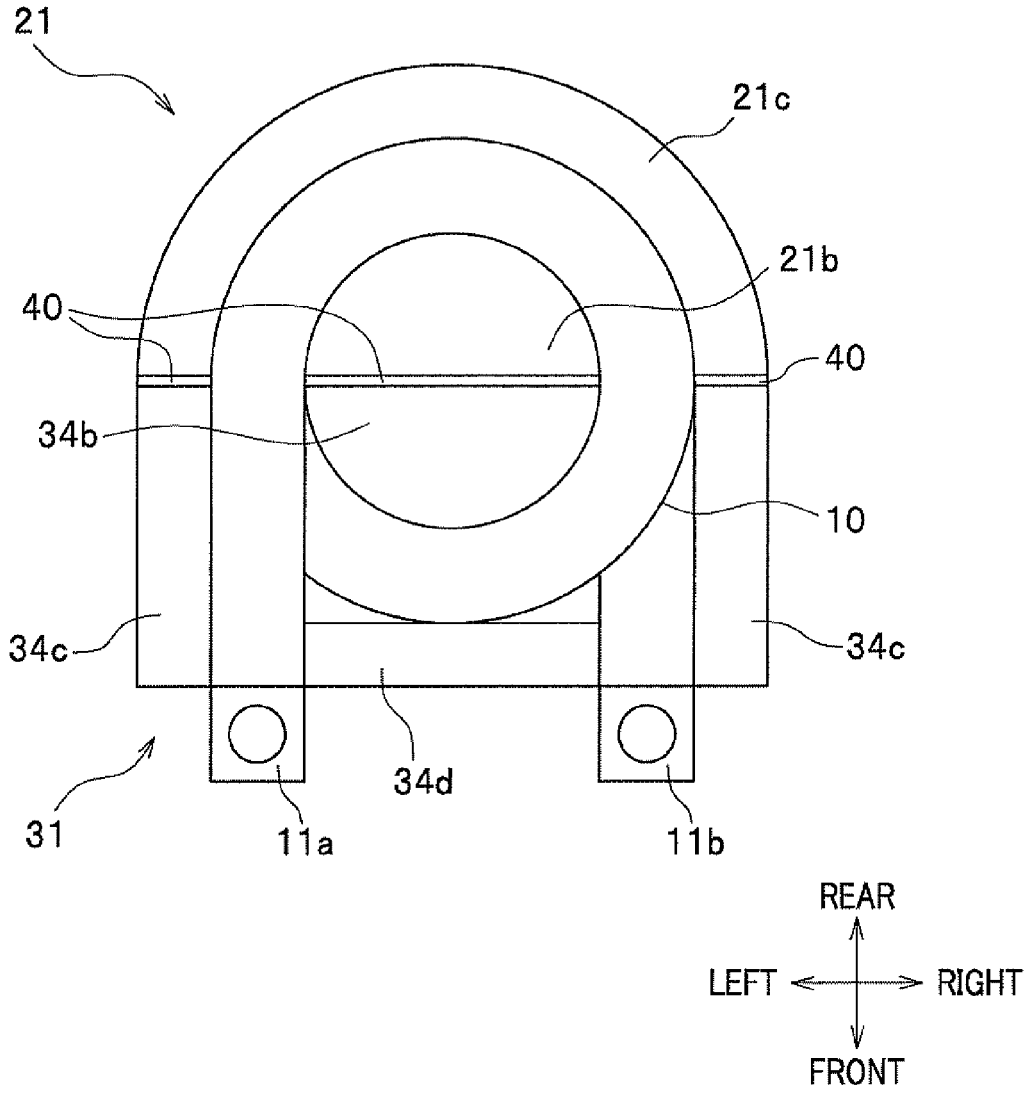
FIG. 3 is a plan view of the composite transformer when a transformer core member and an inductor core member disposed on an upper side are removed.

In addition, the transformer outer magnetic leg portions 24 as shown in FIG. 1B (transformer outer magnetic leg forming portion 21*c* as shown in FIG. 3) are formed in an arc shape (a sector) when viewed from the vertical direction. A center of the arc of the transformer outer magnetic leg portion 24 is set to be coaxial with a center of the semi-circle of the transformer magnetic leg portion 23, and an inner diameter of an inner circumferential surface continuous with the arc shape of the transformer outer magnetic leg portion 24 is equalized to the outer diameter of the windings 10.

A pair of the transformer bases 21*a* and 21*a* are, as shown in FIG. 1B, semi-circle plates, each extending from an outer circumferential surface of the transformer magnetic leg portion 23 toward an inner circumferential surface of the transformer outer magnetic leg portion 24 to connect ends of the transformer magnetic leg portion 23 and ends of the transformer outer magnetic leg portion 24.

Therefore, a pair of the transformer bases 21*a*, 21*a* connect both ends of the transformer magnetic leg portion 23 and the transformer outer magnetic leg portion 24 which extend in parallel to the axial direction of the windings 10, so that as shown in FIG. 1B, an annular transformer core 20 of which a part penetrates inside of the windings 10 can be formed.

Accordingly, magnetic flux generated in the transformer magnetic leg portion 23 disposed inside the windings 10, as shown in FIG. 1B, circulates in the transformer core 20 which is a magnetic path therethrough, so that the transformer core 20 functions as a closed magnetic circuit Bt for the magnetic flux.

In addition, a pair of the transformer bases 21*a*, 21*a* are connected to both ends of the transformer magnetic leg portion 23, and thus can support the windings 10 wound around the transformer magnetic leg portion 23.

Figure 2:
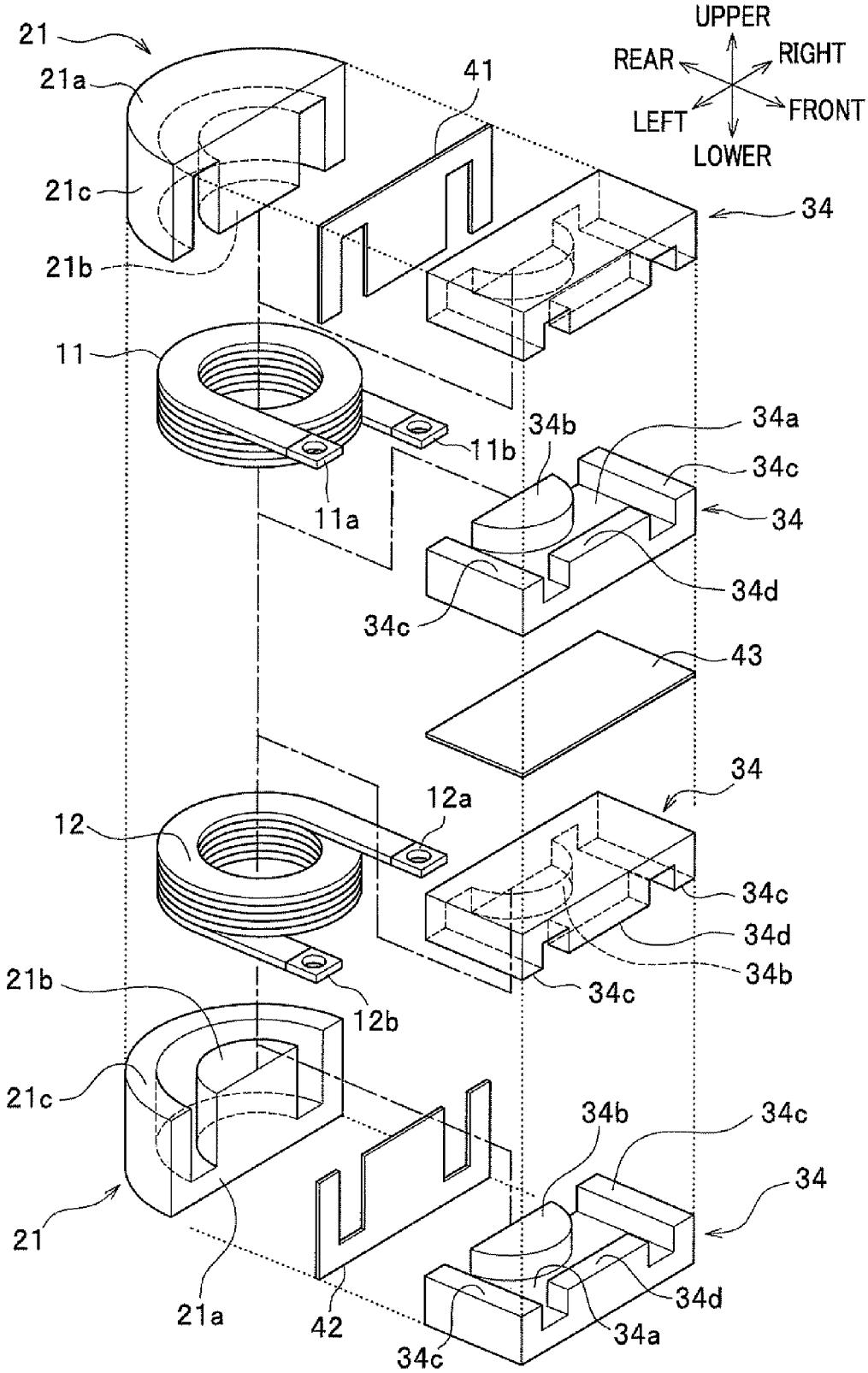
FIG. 2 is an exploded perspective view of the composite transformer shown in FIG. 1.

As shown in FIG. 2, the transformer core 20 can be provided by combining a pair of transformer core members 21, 21. Hereinafter will be described the transformer member 21.

The transformer core member 21 includes, as shown in FIG. 2, the transformer base 21*a* comprising a semicircle plate, a transformer magnetic leg forming portion 21*b*, formed on a flat part of the transformer base 21*a*, having a semicircle column and a transformer outer magnetic leg forming portion 21*c*, formed on a flat part of the transformer base 21*a*, having an arc shape (sector) in a plan view, in which these members are integrally formed.

Because the transformer base 21*a* in the transformer member 21 is the same as a pair of the transformer base 21*a* of the transformer core 20, a detailed description is omitted.

As shown in FIGS. 2 and 3, the transformer magnetic leg forming portion 21*b* is a structural element of the transformer magnetic leg portion 23 and extends from the flat part of the transformer base 21 coaxially with a center of the semicircle plate of the transformer base 21*a* with a semicircle shape on a cross-sectional view. The transformer magnetic leg forming portion 21 is formed to have a vertical length which is a half of a vertical length of the transformer magnetic leg portion 23.

As shown in FIGS. 2 and 3, the transformer outer magnetic leg forming portion 21*c* is a structural element of the transformer outer magnetic leg forming portion 24 and has a vertical length thereof which is a half of a vertical length of the transformer outer magnetic leg portion 24.

As shown in FIG. 2, a pair of the transformer cored members 21, 21 are disposed such that end surfaces of the transformer magnetic outer leg forming portions 21*c* face (contact) each other, and the end surfaces of the transformer magnetic leg forming portion 21*b* and end surfaces of the transformer outer magnetic leg portions 21 are joined each other to form the transformer core 20 which is symmetrical in the vertical directions.

The transformer magnetic leg portion 23 of a semicircle column is formed with the transformer magnetic leg forming portions 21*b*, 21*b*, and the transformer outer magnetic leg portion 24 having an arc shape (sector) is formed with the transformer outer magnetic leg forming portions 21*c*, 21*c*.

As a magnetic material used for the transformer core 20, a material having a high saturation magnetic flux density [T] and a small iron loss [W/kg] is desirable. In addition, magnetic fluxes generated in the transformers core 20 by the two windings 10, which will be described later, have such magnetic flux directions that the magnetic fluxes are cancelled each other, so that the residual magnetic flux can be reduced. Accordingly, regarding a material of the transformer core 20, having a smaller iron loss [W/kg] is prioritized to having a higher saturation magnetic flux density [T], and thus, for example, an Mn—Zn ferrite, a nanocrystal metal, an Fe system amorphous, and a Co-system amorphous can be used.

<Inductor Core 30>

The inductor cores 30 (31, 32) is a magnetic members for storing a magnetic energy generated by the windings 10.

The inductor core 30 comprises, as shown in FIGS. 1A and 1B, the inductor magnetic leg portions 37 on which the windings 10 are wound, the inductor flank magnetic leg portions 38, inductor front magnetic leg portions 39, which extend in parallel to the inductor magnetic leg portions 37, a pair of the inductor bases 34*a* and 34*a* for connecting both ends of the inductor magnetic leg portions 37, the inductor flank magnetic leg portions 38, and the inductor front magnetic leg portions 39.

In the inductor core 30, the inductor flank magnetic leg portions 38, 38 and the inductor front magnetic leg portions 39 are magnetic legs around which the windings 10 are not wound and may also referred to as an inductor outer magnetic portion.

The inductor magnetic leg portions 37 are parts of the magnetic legs around which the windings 10 are wound and extend in the axial direction of the windings 10.

The inductor magnetic leg portions 37 extends, as shown in FIG. 3, in the axial direction with a substantially semicircle cross section when viewed from a vertical direction. A diameter of the semicircle is equalized to an inner diameter of the windings 10. In addition, the inductor magnetic leg portions 37 shown in FIG. 1B (inductor magnetic leg forming portion 34*b* as shown in FIG. 3) extend vertically to have a length equal to a length of the windings 10 in the axial direction.

The inductor flank magnetic leg portions 38, 38 and the inductor front magnetic leg portions 39 are, as shown in FIG. 1A, formed to extend vertically in parallel to the inductor magnetic leg portions 37 outside the outer circumferential surfaces of the windings 10.

The inductor flank magnetic leg portions 38, 38 are, as shown in FIGS. 1A and 3, formed to extend in a line along the connection terminals 11*a* and 11*b* linearly extending from the winging 10. On the other hand, the inductor front magnetic leg portions 39 (front inductor magnetic leg forming portion 34*d*) are formed between the connection terminals 11*a* and 11*b* linearly extending from the windings 10.

A pair of the inductor bases 34*a*, 34*a* extend, as shown in FIG. 2, from an outer surface of the inductor magnetic leg portions 37 to inner surfaces of the inductor flank magnetic leg portions 38, 38 and the inductor front magnetic leg portions 39 to be connected to both ends of the inductor magnetic leg portions 37, the inductor flank magnetic leg portions 38, 38, and the inductor front magnetic leg portion 39.

Accordingly, as shown in FIG. 1B, the inductor core 30 forms an annular shape in which parts thereof penetrate the inside of the windings 10.

Therefore, the magnetic fluxes generated at the parts of the inductor magnetic leg portion 37 circulate in the inductor core 30, so that the inductor cores 30 functions as closed magnetic circuits BL for the magnetic fluxes.

Figure 4:
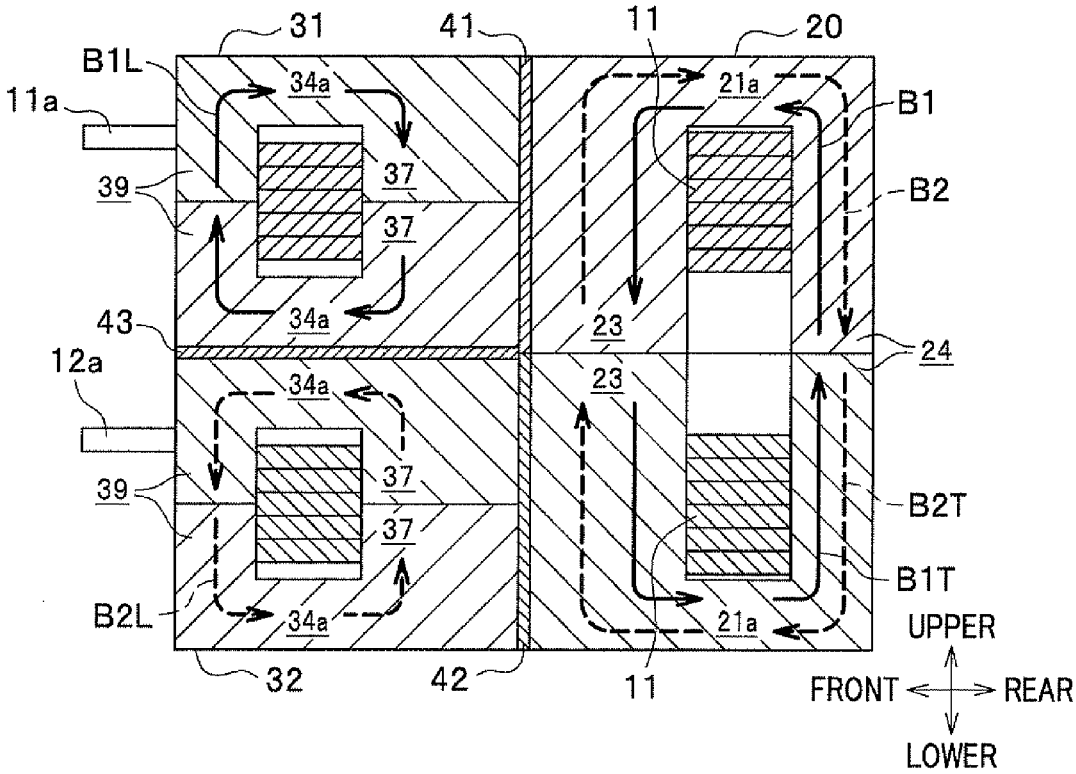
FIG. 4 is a cross section view of the composite transformer, taken along a line A-A in FIG. 1.
Figure 5:
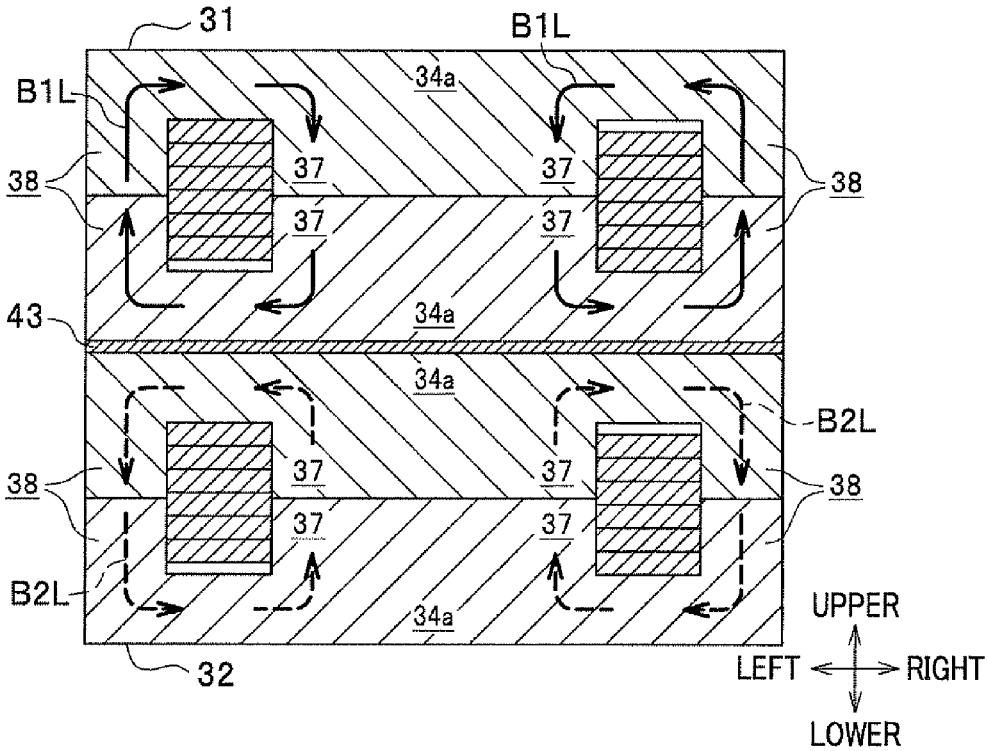
FIG. 5 is a cross section view of the composite transformer, taken along a line B-B in FIG. 1.

In the closed magnetic circuits BL in the inductor core 30, there are the inductor flank magnetic leg portions 38, 38 and the inductor front magnetic leg portion 39 as magnetic circuits connecting a pair of the inductor bases 34*a*, 34*a* in addition to the inductor magnetic leg portions 37 as shown in FIGS. 4 and 5. Accordingly, the inductor flank magnetic leg portions 38, 38 or the inductor front magnetic leg portions 39 are magnetic closed circuit BL of the inductor core 30.

In addition, the composite transformer 1 according to the embodiment includes two inductor cores 30, 30 which are disposed in vertical direction in which the transformer magnetic leg portions 23 extend.

The two inductor cores 30, 30 disposed in the vertical direction are disposed such that the inductor magnetic leg portion 37 is next to the transformer magnetic leg portions 23. Accordingly, as shown in FIG. 1B, a magnetic leg portion 36 is formed in a circular column with the inductor magnetic leg portion 37 of the inductor core 30, a transformer magnetic leg portion 23, and magnetic insulation sheets 40.

In addition, the composite transformer includes two inductor cores 30, 30 which are disposed vertically as shown in FIGS. 1A and 1B. Hereinafter, the inductor core 30 will be described. As needed, the inductor core 30 disposed on the upper side is referred to as an upper inductor core 31 and the inductor core 30 disposed on the lower side is referred to as a lower inductor 32.

As mentioned above, the inductor core 30 can be formed by combining a pair of the inductor core members 34, 34.

Hereinafter will be described the inductor core members 34.

The inductor core member 34 includes, as shown in FIG. 2, an inductor base 34*a* formed in a plate having a flat portion, an inductor magnetic leg forming portion 34*b* formed on the flat portion of the inductor base 34*a*, inductor flank magnetic leg forming portions 34*c*, 34*c*, and the front inductor magnetic leg forming portion 34*d*, which are integrally formed.

Because the inductor base 34*a* in the inductor core 31 has the same configuration as a pair of the inductor bases 34*a* which are a part of the inductor core 30, a detailed description will be omitted.

The inductor magnetic leg forming portion 34*b* is a structural element of the inductor magnetic portion 37 and disposed, as shown in FIG. 2, on a flat portion of the inductor base 34*a* formed in a semicircle column extending from a rear end edge thereof to a front end when viewed from a vertical direction.

A vertical length of the inductor magnetic leg forming portion 34*b* is half of the vertical length of the inductor magnetic leg portion 37.

The inductor flank magnetic leg forming portions 34*c*, 34*c* are structural elements of the inductor flank magnetic leg portions 38, 38 on a flat portion of the inductor base 34*a* and extend from left and right side ends inwardly to have a rectangular shape when viewed from the vertical direction.

The front inductor magnetic leg forming portions 34*d*, 34*d* are structural elements of the inductor front magnetic leg portions 39, 39 on a flat portion of the inductor base 34*a* and extend from left and front ends inwardly to have a rectangular shape when viewed from the vertical direction.

Two inducer core members 34, 34 are combined such that as shown in FIG. 2, the inductor magnetic leg forming portions 34*b* in the two inductor core members 34, 34 are located on the rear side, the inductor flank magnetic leg forming portions 34*c*, 34*c* are located on left and right sides, and the front magnetic forming portions 34*d* are located on the front side.

Next, end surfaces of the inductor magnetic leg forming portions 34*b* of the two inductor core members 34, 34, end surfaces of the inductor flank magnetic leg forming portions 34*c*, 34*c*, and the end surfaces of the front inductor core magnetic forming portions are connected to form the inductor core 30.

The inductor core 30 is between the inductor bases 34*a*, 34*a*, and the inductor magnetic leg portion 37 having the semi-circle column at a rear and middle part of the inductor core 30, the inductor flank magnetic leg portions 38, 38 are formed on the left and right sides of the inductor core 30, and the inductor front magnetic leg portion 39 are formed in front thereof.

As the inductor core 30, a material having a higher saturation magnetic flux density [T] and a smaller iron loss [W/kg] is preferable. However, the magnetic flux generated in the inductor core is mainly caused by leaked magnetic flux. Accordingly, as the material for the transformer core, having a smaller saturation magnetic flux density [T] is prioritized to having a higher iron loss [W/kg]. For example, a dust permalloy, a pressed powder core, a pressed powder silicon steel, and a silicon steel plate are usable.

<Magnetic Insulation Sheet 40>

The magnetic insulation sheet 40 is a sheet member having a low magnetic permeability for isolating magnetic fields generated in the transformer core 20, and the inductor core 30.

The magnetic insulation sheet 40 comprises, as shown in FIG. 2, a first magnetic insulation sheet portion 41 disposed between the transformer core 20 and the inductor core 30 (31), a second magnetic insulation sheet portion 42, a third magnetic insulation sheet portion 43 disposed between the inductor cores 30 (31, 32).

The first to third magnetic insulation sheet portions 41 to 43 are formed to be thin and to have a size corresponding to the disposed location.

The first and second magnetic insulation sheet portions 41 and 42, which are disposed between the transformer core 20 and the inductor cores 30 (31, 32), have notches for allowing the windings 10 to pass therethrough because the windings 10 exist both in the transformer core 20 and the inductor cores 30.

Next, winding the windings 10 around the magnetic leg portion 36 will be described.

The first and second windings 11 and 12 of the two windings 10 are wound around the magnetic leg portion 36 and the connection terminals 11*a*, 11*b*, 12*a*, 12*b* of the first and second windings 11 and 12 extend in the front direction of the composite transformer 1. Accordingly, leads (connection terminals) of the first and second windings 11 and 12 are drawn (extend) in the same direction.

In addition, the first and second windings 11 and 12 are wound in opposite directions such that in the closed magnetic circuit BT of the transformer magnetic leg portion 23 forming the magnetic leg portion 36, the magnetic flux B1T generated by the first winding 11 and the magnetic flux B2T generated by the winding 12 are canalled out each other (in opposite direction).

For example, it is assumed that the connection terminal 11*a* of the first winding 11 and the connection terminal 12*a* of the second winding 12 are connected to a positive terminal and the connection terminal 11*b* of the first winding 11 and the connection terminal 12*b* of the second winding 12 are connected to a negative terminal.

In this case, the first winding 11 is wound around the magnetic leg portion 36 clockwise when viewed from an upper side, and the second winding 12 is wound around the magnetic leg portion 36 counterclockwise when viewed from the upper side.

Accordingly, the magnetic flux direction of the magnetic flux B1T generated by the first winding 11 is, as shown in FIG. 4, downward in the transformer magnetic leg portion 23 of the transformer core 20 and upward in the transformer outer magnetic leg portion 24. On the other hand, the magnetic flux direction of the magnetic flux B2T generated by the second winding 12 is, as shown in FIG. 4, in an upward direction in the transformer magnetic leg portion 23 of the transformer core 20, and in a downward direction in the transformer outer magnetic leg portion 24. Accordingly, the magnetic flux B1T generated by the first winding 11 and the magnetic flux B2T generated by the second winding 12 are opposite in direction and cancelled out.

Hereinafter, it is assumed that when a current flow through the first winding 11, as shown in FIG. 4, a magnetic flux B1 is generated in the magnetic leg portion 36 around which the first winding 11 is wound, a magnetic flux generated in the transformer core 20 by the first winding 11 is referred to as B1T and a magnetic flux generated in the inductor core 30 is referred to as a magnetic flux B1L.

In addition, it is assumed that the magnetic flux generated by the second winding 12 is a magnetic flux B2, and a magnetic flux generated in the inductor core 30 is referred to as a magnetic flux B2L.

Next, will be described a method of using the composite transformer 1.

When a current flows from the connection terminal 11*a* to the connection terminal 11*b* of the first winding 11, as shown in FIG. 4, the magnetic flux (B1T, B1L) is generated in the magnetic leg portion 36 around which the first winding 11 is wound.

In the transformer magnetic leg portion 23 which is a part forming the magnetic leg portion 36, the direction of the magnetic flux B1T is a downward direction, and the magnetic flux B1T passes through the transformer base 21*a* on the lower side and advances to the transformer outer magnetic leg portion 24. A direction of the magnetic flux B1T in the transformer outer magnetic leg portion 24 is an upward direction, and the magnetic flux B1T passes through the transformer base 21*a* on the upper side, advances to the transformer outer magnetic leg portion 24, and returns to the transformer magnetic leg portion 23 to circulate the transformer core 20.

In this operation, the magnetic flux B1T crosses the inside of the second winging 12, which cause a magnetically induction in the second winding 12.

Accordingly, a current flows in the second winding 12 with boosting. The current flows from the connection terminal 12*b* of the second winding 12 connected to the positive terminal to the connection terminal 12*a* of the second winding connected to the negative terminal, so that this configuration function as a transformer.

Next, will be described the magnetic flux B1L generated in the upper inductor core 31 around which the first winging is wound.

In the closed magnetic circuit BL in the upper inductor core 31, the magnetic flux B1L is generated in a downward direction in the inductor magnetic leg portion 37 around which the first winding 11 is wound. The magnetic flux B1L advances from the inductor magnetic leg portion 37 to the inductor base 34*a* on the lower side.

As shown in FIGS. 4 and 5, because the inductor base 34*a* is connected to the inductor front magnetic leg portion 39 and the inductor flank magnetic leg portion 38, the magnetic flux B1L advances both to the inductor front magnetic leg portion 39 and the inductor flank magnetic leg portion 38.

Accordingly, in the inductor front magnetic leg portion 39 and the inductor flank magnetic leg portion 38, the magnetic flux B1L of which direction is upward is generated.

The magnetic flux B1L generated in the inductor front magnetic portions 39 and the inductor flank magnetic leg portions 38 passes through the inductor base 34*a* on the upper side, advances the inductor magnetic leg portion 37, and thus circulates the closed magnetic path BL of the upper inductor core 31.

Accordingly, as long as the current flows through the first winding 11, the magnetic flux generated in the upper inductor core 31 is stored in the upper inductor core 31, which functions as an inductor.

Next, will be described a case where a current flows through the second winding 12.

When a current flows from the connection terminal 12*b* to the connection terminal 12*a* of the second winding 12, as shown in FIG. 4, the magnetic flux B2 (B2T, B2L) is generated in the magnetic leg portion 36 around which the second winding 12 is wound.

In the transformer magnetic leg portion 23 which is a part forming the magnetic leg portion 36, the direction of the magnetic flux B2T is a upward direction, and the magnetic flux B2T advances to the transformer base 21*a* on the upper side.

The magnetic flux B2T passes through the transformer base 21*a* on the upper side, advances to the transformer outer magnetic leg portion 24 in which the direction of the magnetic flux B2T is the downward direction.

Accordingly, the magnetic flux B2 has such a magnetic flux as to pass through the transformer base 21*a* on the lower side and returns to the transformer magnetic leg portion 23 to circulate the transformer core 20.

In this operation, the magnetic flux B2T crosses an inside of the second winging 12 within the inside thereof, which causes magnetically induction in the first winding 11.

Accordingly, a current flows in the first winding 11 with boosting. The current flows from the connection terminal 11*a* of the first winding 11 connected to the positive terminal to the connection terminal 11*b* of the first winding connected to the negative terminal, so that this configuration functions as a transformer.

Next, will be described the magnetic flux B2L generated in the lower inductor core 32 around which the second winging 12 is wound.

In the lower inductor core 32, the magnetic flux B2L is generated in the upward direction in the inductor magnetic leg portion 37 around which the second winding 12 is wound. The magnetic flux B2L advances from the inductor magnetic leg portion 37 to the inductor base 34*a* on the upper side.

As shown in FIGS. 4 and 5, because the inductor base 34*a* is connected to the inductor front magnetic leg portion 39 and the inductor flank magnetic leg portion 38, the magnetic flux B2L advances both to the inductor front magnetic leg portion 39 and the inductor flank magnetic leg portion 38.

Accordingly, in the inductor front magnetic leg portion 39 and the inductor flank magnetic leg portion 38, the magnetic flux B2L of which direction is downward is generated.

The magnetic flux B2L generated in the inductor front magnetic portions 39 and the inductor flank magnetic leg portions 38 passes through the inductor base 34*a* on the lower side, advances to the inductor magnetic leg portion 37, and thus circulates the lower inductance core 32.

Accordingly, as long as the current flows through the second winding 12, the magnetic flux generated in the lower inductor core 32 is stored in the lower inductor core 32, which functions as an inductor.

According to the composite transformer 1 down-sizing can be provided as well as the magnetic flux B1T generated in the first winging 11 is opposite in direction to the magnetic flux B2T generated in the second winding 12. Therefore, the residual magnetic flux in the transformer core 20 can be reduced. This can prevent a magnetic saturation in the transformer core 20.

In addition, the composite transformer 1 can prevent the magnetic flux from being saturated because the transformer magnetic leg portion 23 is formed to be long. Accordingly, a loss in magnetic energy caused by that the magnetic fluxes B1T and B2T exceed a saturation magnetic flux density of the transformer core 20 can be avoided. Particularly, the residual magnetic flux (in particular, a residual magnetic flux DC magnetic flux) can be reduced.

In addition, according to the composite transformer 1, the two windings 10 are covered with the transformer outer magnetic leg portion 24, the inductor flank magnetic leg portion 38, and the inductor front magnetic leg portion 39. This configuration can decrease a possibility of receiving an influence on the windings 10 from other magnetic fields.

In addition, according to the composite transformer 1, the connection terminals 11*a* and 11*b* of the first winding 11, and the connection terminals 12*a* and 12*b* of the second winding 12 extend in the same direction from the winding body.

Therefore, wires connected to the composite transformer 1 can be gathered in one side thereof, so that a DC/DC converter using the composite transformer 1 can be more down-sized.

In addition, according to the composite transformer 1, as a part of the transformer core member 21, production of one kind of parts is enough for manufacturing the transformer core 20 because the transformer core 20 is formed with two transformer core members 21. This suppresses increase in the number of parts to be produced. Similarly, the inductor core 30 is formed with the two inductor core members 34, which suppresses increase in the number of the parts to be produced.

The composite transformer according to the embodiment of the present invention has been described. However, the composite transformer 1 is not limited to the above-mentioned description. For example, in the composite transformer 1, the inductance cores 30 are disposed in front the connection terminals 11*a*, 11*b*, 12*a*, and 12*b* with respect to the two windings 10, and the transformer core 20 is disposed on the rear side. However, it is also possible to dispose the transformer core 20 in the front side and the two inductor cores 30 are disposed on the rear side. In this case, through holes or notches for drawing the connection terminals 11*a*, 11*b*, 12*a*, and 12*b* from the two windings 10 become necessary.

EXAMPLE

Hereinafter, will be described examples according to the embodiment of the present invention.

In this example, the composite transformer 1 is installed in a DC-DC converter and a boosting operation is performed by turning on and off the switching elements.

In addition, the number of turns of the windings installed in the composite transformer is changed and a volume of the composite transformer having the number of turns of windings is calculated.

In addition, every time composite transformer of which the number of turns of the winding is changed, a copper loss and an iron loss (W), which are losses in the magnetic part, are calculated. In addition, the calculation condition of the applied voltages, etc. are given in Table 1.

TABLE 1

| Applied voltage($V_{in}$) | Input current ($I_{in}$) | Output power ($P_{out}$) | Frequency of switching element ($T_{sw}$) | Ripple current($V_{in}$) |
|---|---|---|---|---|
| 70 V | 150 A | 10.5 Kw | 45 KHz | 17 Ap-p |

In the composite transformer of the example, ferrite is used as a material of the transformer core, and dust permalloy is used as a material of the inductor core.

Figure 6A:
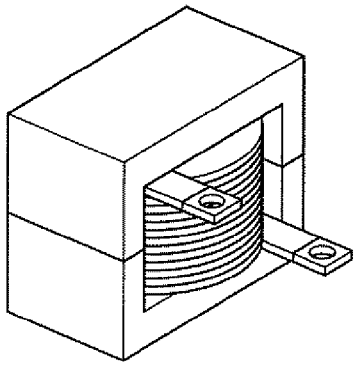
FIGS. 6A to 6C are perspective views of comparative transformers described in description of an example.
Figure 6B:
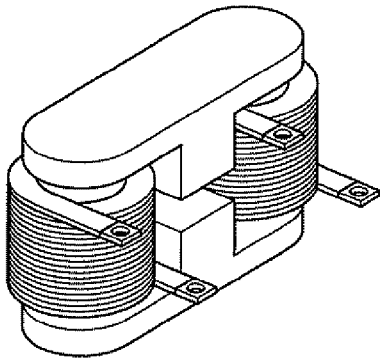
Figure 6C:
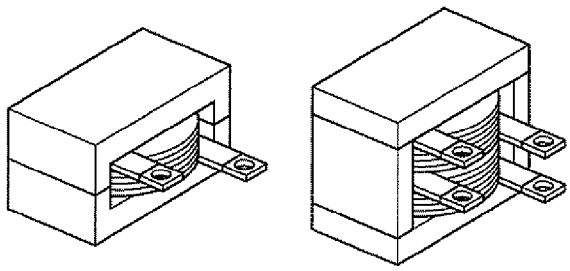

For comparing with the measurement result of the composite transformer, comparative examples 1 to 3 are prepared by the inventors. In comparative example 1, a conventional type of inductor is prepared as shown in FIG. 6A in which dust permalloy is used as a material of the core. In comparative example 2, a lose-coupled inductor is prepared in which ferrite is use as the core. In comparative example 3, an L type chopper in which dust permalloy is used as the core is combined with a magnetic field cancellation transformer in which ferrite is used as a material of the core.

Figure 7:
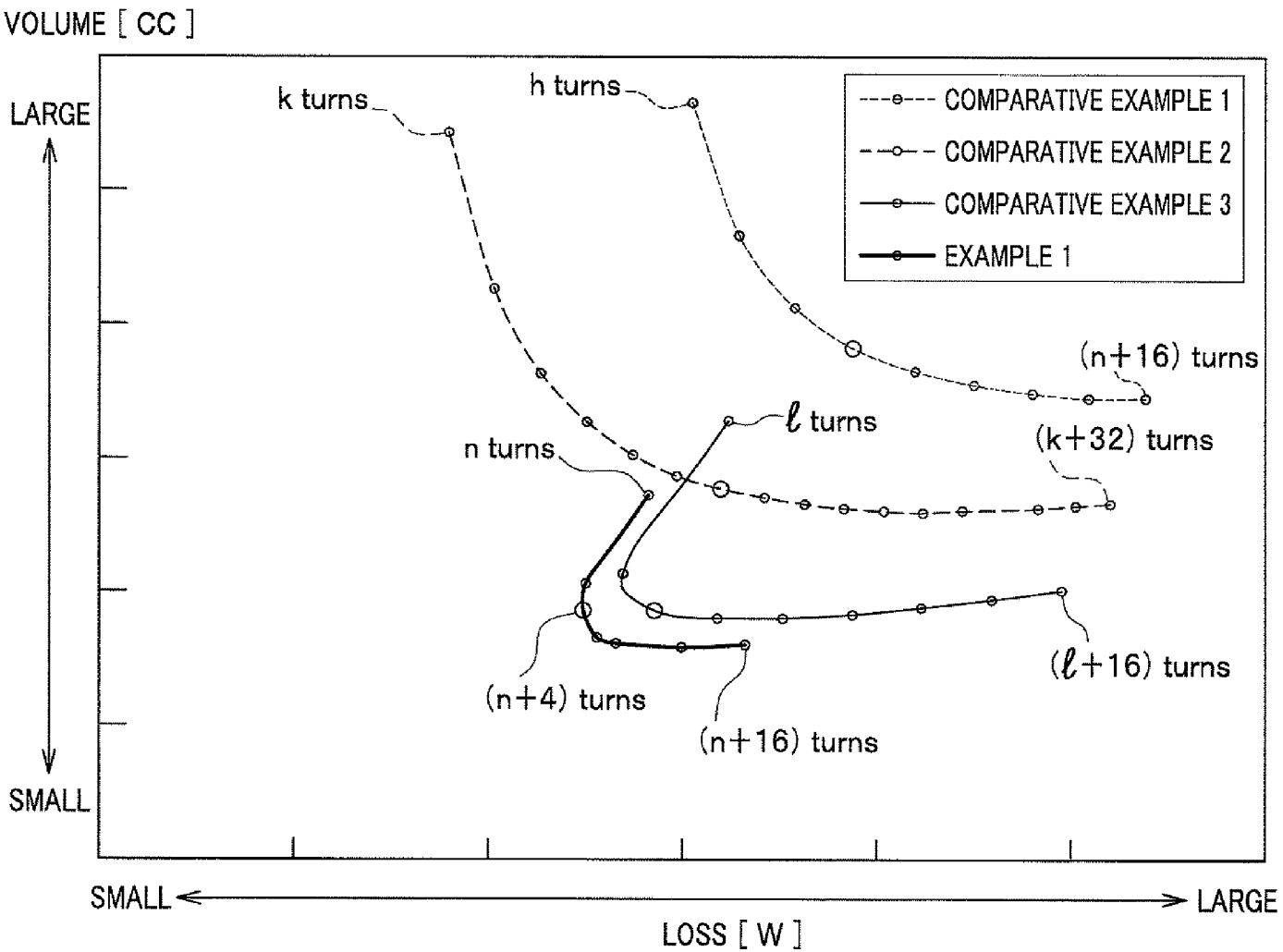
FIG. 7 is a chart showing measurement result of magnetic energy loss quantity regarding volume of the example 1 and comparative examples 1 to 3 in which the number of the windings are varied.

The windings in the comparative examples and the example of the present invention are the same type. FIG. 7 shows the measurement results. In FIG. 7, an axis of ordinate represents a volume, and thus a volume value increases from a lower part toward the upper part. An axis of abscissa represents the copper loss and the iron loss of magnetic parts and thus the value increases from left side to the right side. Accordingly, the lower and more leftward a plot point locates, the smaller size and the smaller loss the transformer has.

Generally, the plots of the result of the example 1 locates more downward and leftward than the results of the comparative examples 1 to 3. Accordingly, the composite transformer of the example 1 shows that down-sizing and decrease in magnetic energy loss are more done than the conventional composite transformer.

The invention claimed is:

1. A combined type of transformer comprising:

two windings;

a transformer core including a transformer magnetic leg portion around which the windings are wound, the transformer magnetic leg portion extending in the axial direction of the windings;

two inductor cores disposed in the axial direction, each including an inductor magnetic leg portion around which one of the windings is wound and being disposed next to the transformer core, wherein when at least one of the windings is conducted, a magnetic flux is generated at the transformer magnetic leg portion and the inductor magnetic leg portions, which provides functions of a transformer and inductors, wherein the transformer core comprises:

the transformer magnetic leg portion;

a transformer outer magnetic leg portion extending in parallel to the transformer magnetic leg portion, disposed outside an outer circumferential surface of the windings; and a pair of transformer bases respectively connecting ends of the transformer magnetic leg portion and ends of the outer magnetic leg portion;

wherein each of the inductor cores comprises:

the inductor magnetic leg portion;

an inductor outer magnetic leg portion extending in parallel to the inductor magnetic leg portion, disposed outside an outer circumferential surface; and a pair of inductor bases respectively connecting ends of the inductor magnetic leg portion and ends of the inductor outer magnetic leg portion, and wherein the windings are wound to generate magnetic fluxes in such directions that the magnetic fluxes are cancelled out in a magnetic closed circuit in the transformer core.

2. The combined type of transformer as claimed in claim 1, wherein the windings include connection terminals to be connected to both polarity terminals of an external electric circuit, and the connection terminals extend in the same direction.

3. The combined type of transformer as claimed in claim 2, further comprising a magnetic insulation sheet between the transformer core and the inductor core.

4. The combined type of transformer as claimed in claim 1, further comprising a magnetic insulation sheet between the transformer core and the inductor core.

5. The combined type transformer as claimed in claim 1, wherein the transformer base comprises a semicircle plate, a transformer magnetic leg portion formed on a flat port of the transformer base having a semicircle column, and a transformer outer magnetic leg framing portion, formed on a flat part of the transformer base having an arc shape in a plan view.

6. The combined type transformer as claimed in claim 5, wherein the transformer magnetic leg forming portion is a structural element of the transformer magnetic leg portion and extends from the flat part of the transformer base coaxially with a center of the semicircle plate of the transformer with a semicircle shape on a cross-sectional view.

7. The combined type transformer as claimed in claim 6, wherein the transformer magnetic leg portion of a semicircle column is formed with the transformer magnetic leg forming portions, and the transformer outer magnetic leg portion having an arc shape is formed with the transformer outer magnetic leg forming portions.

* * * * *